US007036433B2

(12) United States Patent
Beal

(10) Patent No.: US 7,036,433 B2
(45) Date of Patent: May 2, 2006

(54) AMMUNITION PROJECTILE HAVING ENHANCED AERODYNAMIC PROFILE

(76) Inventor: Harold F. Beal, 6277 Sierra Cir., Rockford, TN (US) 37853

( * ) Notice: Subject to any disclaimer, the term of this patent is extended or adjusted under 35 U.S.C. 154(b) by 290 days.

(21) Appl. No.: 10/391,881

(22) Filed: Mar. 19, 2003

(65) Prior Publication Data

US 2004/0016357 A1 Jan. 29, 2004

Related U.S. Application Data

(60) Provisional application No. 60/366,132, filed on Mar. 20, 2002.

(51) Int. Cl.
*F42B 10/00* (2006.01)

(52) U.S. Cl. ..... 102/519; 102/514; 102/507

(58) Field of Classification Search ..... 102/519, 102/514, 507

See application file for complete search history.

(56) References Cited

U.S. PATENT DOCUMENTS 1,107,948 A * 8/1914 Hoagland ..... 102/507
3,136,052 A * 6/1964 Ghislain ..... 72/370.12
3,157,137 A * 11/1964 Burns, Jr. ..... 102/509
4,777,883 A * 10/1988 Chevich ..... 102/503
5,069,869 A * 12/1991 Nicolas et al. ..... 419/28
5,357,866 A * 10/1994 Schluckebier et al. ..... 102/509
5,528,990 A * 6/1996 Corzine et al. ..... 102/514

* cited by examiner

*Primary Examiner*—Michael J. Carone
*Assistant Examiner*—M. Thomson
(74) *Attorney, Agent, or Firm*—Pitts & Brittian, P.C.

(57) ABSTRACT

A projectile 10 for gun ammunition of a size not greater than 50 caliber comprising a solid metal jacket 82 of generally cup-shaped geometry and having a closed end 102 and an open end 88, a core 84 formed from a mixture of metal powders, not including lead, which mixture is cold-pressed into a self-supporting compact and disposed within said jacket, the core incompletely filling the jacket, an ogive 14 having an outer surface and defined on the initially open end of said jacket, and a conical tip 122 defined on the distal end 118 of said ogive, the tip having an outer surface 22 which defines an angle with respect to the longitudinal centerline 24 of the projectile that is greater than the angle defined by the ogive with respect to the longitudinal centerline of the projectile. A method is disclosed.

9 Claims, 4 Drawing Sheets

AMMUNITION PROJECTILE HAVING ENHANCED AERODYNAMIC PROFILE

RELATED APPLICATIONS

This application is a non-provisional application and claims priority based on Provisional Application Ser. No. 60/366,132 filed Mar. 20, 2002 entitled AMMUNITION PROJECTILE HAVING ENHANCED AERODYNAMIC PROFILE.

FIELD OF INVENTION

The present invention relates to gun ammunition and particularly to projectiles for gun ammunition.

BACKGROUND OF INVENTION

For many years, lead has been the standard metal for use in the manufacture of projectiles for gun ammunition. Lead, however, has been found to be toxic and its elimination from gun ammunition projectiles is currently in progress. Because of this long-standing reliance upon lead as the basic metal for the manufacture of gun ammunition projectiles, the art/science of manufacture of gun ammunition projectiles has languished in mediocrity.

Of recent vintage are gun ammunition projectiles formed from metal powders which are compacted into shaped projectiles or which are compacted and thereafter formed into shaped projectiles. There are myriad problems associated with the manufacture of projectiles employing metal powder(s) as the basic material of the projectile. One of these problems relates to the ultimate formation of a pressed powder compact into an aerodynamically acceptable projectile.

Commonly, in the current state of the art, pressed powder compacts, referred to often as "cores", are loaded into a jacket, such as a cup-shaped copper metal jacket. The core in the jacket is seated against the closed end of the jacket ("core seating"), and the open end of the jacket is formed about the core and shaped to define an aerodynamically desirable leading end of the projectile. For purposes of at least partially closing the open end of the jacket while defining the desired aerodynamic shape on that end of the core/jacket combination which will become the leading end of the projectile when it is fired from a gun, the core is chosen to be shorter in length than the depth of the jacket so that there is a portion of the jacket wall adjacent the open end of the jacket which is void of core material when the seating operation has been completed.

Core seating takes places with the core/jacket combination being held in a die while pressure is applied axially of the core to seat the core within the closed end of the jacket, and in part, to the side wall of the jacket. Thereafter, and usually in a different die, the open end of the jacket is formed inwardly toward the longitudinal centerline of the jacket. This operation may take place in steps, and may involve more than one die, but in the end, the initially open end of the jacket is closed to the extent desired. The initially open end of the jacket may be fully closed or partially closed, in part depending upon the desired terminal ballistics of the projectile.

In certain projectiles, it is desired that the projectile substantially disintegrate upon striking a target, often disintegrating only after limited penetration into a target. Maximum disintegration in these projectiles is desired, including maximum disintegration of the jacket into very small fragments, and disintegration of the powder-based core into particulates which are on the order of the individual particle size of the powder employed in forming the core.

Disintegration of a jacketed projectile, even projectiles formed from lead cores, is known to be enhanced through the use of a "hollow point" at the leading end of the jacketed projectile. However, hollow pointed projectiles suffer from several shortcomings, such as their tendency to misfeed from magazines into the breech of a semi-automatic or automatic weapon; their relatively inefficient aerodynamic effect upon the flight of the projectile to a target; and other ill effects, all of which must be balanced against the requirement that the projectile disintegrate to the fullest extent upon striking a target.

SUMMARY OF INVENTION

In accordance with the present invention, there is provided a projectile for gun ammunition wherein the leading end of the projectile comprises an ogive geometry, and a relatively short length of the extreme distal tip of the ogive portion of the projectile is further infolded toward the centerline of the jacket by a relatively few degrees, thereby defining a tapered tip on the extreme distal end of the ogive portion of the projectile. The ogive end of the jacket, after the tipping operation, may by partially filled with core material leaving a void volume in the most distal portion of the open end of the jacket, so that there may be defined a meplat cavity proximate the partially closed end of the jacket, the cavity opening outwardly of the jacket. Optionally, the ogive end of the jacket may be essentially fully closed.

This "double-infolding" of the initially open end of the jacket (herein referred to as "tipping" of the ogive portion of the projectile) has been found to provide enhanced aerodynamic properties of the projectile, such as reduced resistance to movement through air, enhanced accuracy of delivery to a target, even under adverse wind conditions, and particularly enhanced disintegration of the projectile upon striking a target. The latter feature appear to take the form of an implosion of the tapered tip of the jacket in a direction inwardly and generally along the longitudinal centerline of the jacket. This implosion, as opposed to a explosive action in which the jacket disintegrates into fragments which are propelled generally radially away from the projectile, comprises movement of at least the tipped portion of the jacket inwardly of the jacket and along the longitudinal centerline of the jacket, thence into the core itself, thereby contributing to the disintegration of the core along with the remainder of the jacket.

Moreover, the present invention has been found to materially, 50% or greater, reduce the aerodynamic drag on the projectile over the course of its trajectory to a target. As a result, the present projectile travels from the gun to the target faster than occurs in the absence of the present invention thereby permitting the same quantity of gun powder to produce a much higher velocity, at the target because of reduced drag, hence less loss of velocity during flight of the present projectile to a target. This feature has been found to provide enhanced accuracy of delivery of the projectile at extended target distances, such as 1 minute of angle accuracy at 1000 yards, even under adverse wind conditions. No known projectile exhibits this degree of velocity retention and delivery accuracy to a target 1000 yards distance from the gun from which the projectile is fired.

DETAILED DESCRIPTION OF INVENTION

Figure 1:
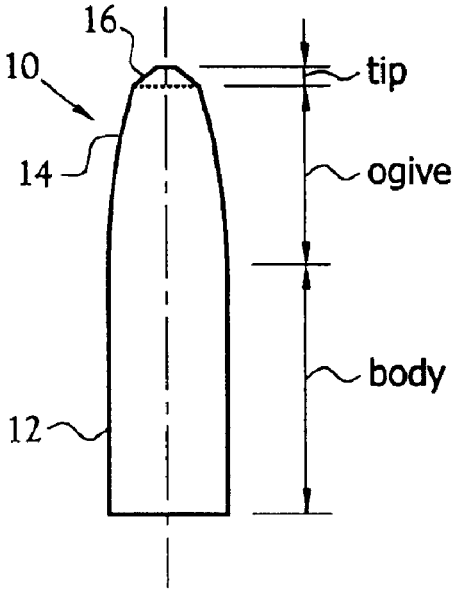
FIG. 1 is a representation of a projectile embodying various of the features of the present invention and in which the profile of the projectile has been exaggerated to better portray the features of the present invention.

Referring to FIG. 1, there is depicted, somewhat exaggerated for purposes of illustration, a projectile 10 including a body portion 12 of generally straight cylindrical geometry, an ogive portion 14, and a tipped portion 16 at the extreme distal end 16 of the ogive. The tipped ogive portion of the projectile defines the leading end of the projectile when it is fired from a weapon. As noted the angularity of the tipped portion 16 is somewhat exaggerated for illustration purposes.

Figure 2:
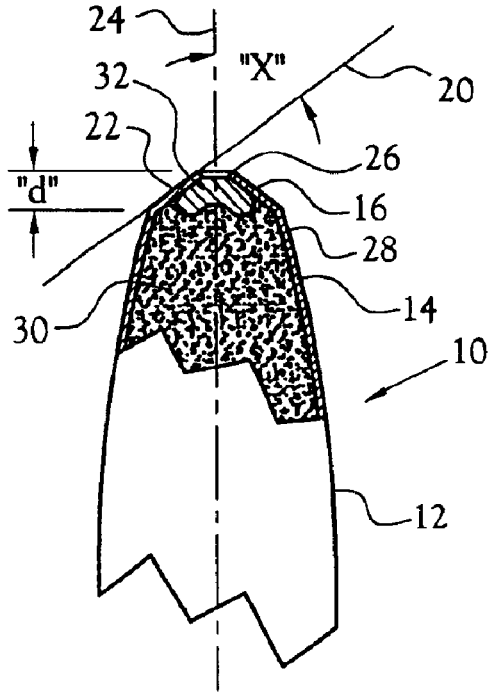
FIG. 2 is a representation of a projectile as depicted in FIG. 1 and depicting an exaggerated enlarged different angle of deformation of the extreme distal tip of the jacket.

FIG. 2 depicts an enlarged and even more exaggerated embodiment of the leading end of the projectile depicted in FIG. 1. In FIG. 2, it may be seen that the extended side surface line 20 of the side 22 of the tip defines an angle "$X^{31}$ relative to the longitudinal centerline 24 of the projectile. The depth "d" of the tip is measured from distal end 26 of the jacket 28 of the projectile inwardly along the longitudinal centerline of the projectile.

The projectile of FIG. 2 comprises a metal, preferably copper, jacket 28 which houses a quantity of a mixture of two or more metal powders 30 and a plug 32, commonly of a hollow hemispherical geometry formed from a disc, preferably of a metal such as tin, as described in U.S. Pat. Nos. 5,789,698 and 6,371,029, the entirely of both of which are incorporated herein by reference.

Figure 3:
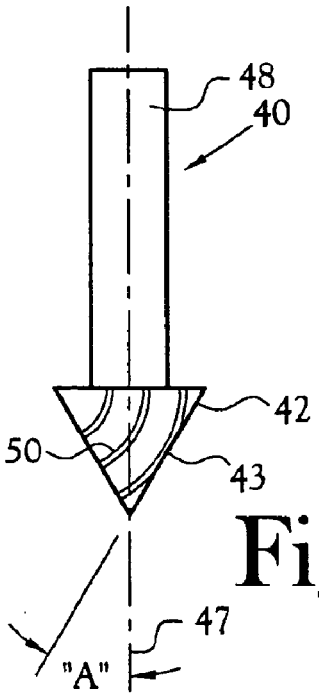
FIG. 3 depicts one embodiment of a reamer useful in one step in the method of manufacture of a die punch useful in the manufacture of the projectile of the present invention.
Figure 7:
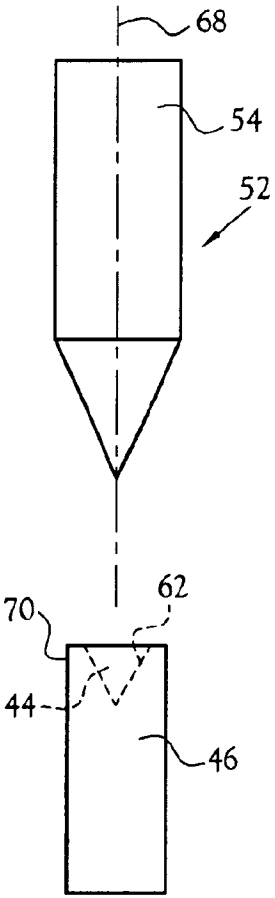
FIG. 7 depicts the setup step for hobbing the die punch reamed as depicted in FIG. 5.

In accordance with one method for the production of a tipped ogive of a projectile of the present invention, there is employed a reamer 40 such as depicted in FIG. 3 having a conical cutting end 42 for the milling of a conical depression 44 in the end of a die punch 46 (see FIG. 7). The extension of the outer wall 43 of the depicted conical cutting end 42 of the reamer defines a 45 degree angle "A" with respect to the longitudinal centerline 47 of the mounting shank 48 of the reamer. Preferably a two-fluted 50 reamer is employed.

Figure 4:
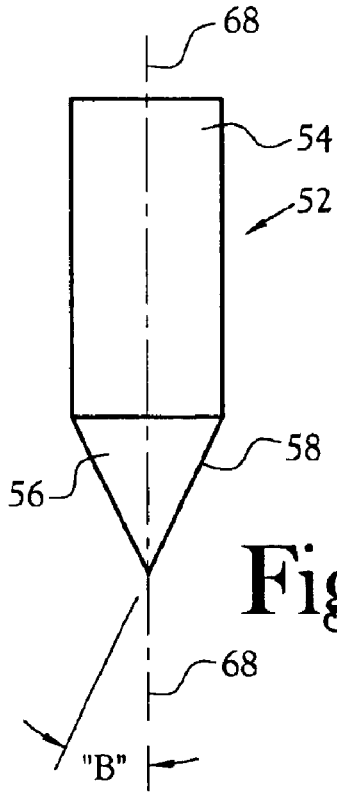
FIG. 4 depicts one embodiment of a hob useful in one step in the method of manufacture of the die punch useful in the manufacture of the projectile of the present invention.
Figure 5:
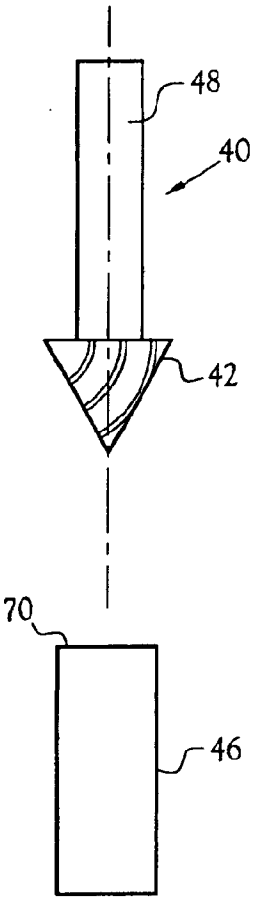
FIG. 5 depicts the setup step for reaming a die punch useful in the method of manufacture of the projectile of the present invention.
Figure 6:
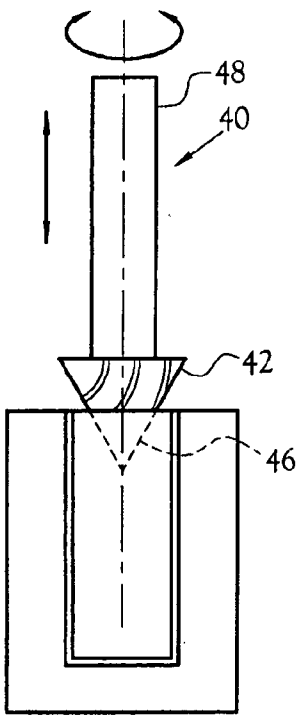
FIG. 6 depicts the step of reaming a die punch pursuant to the setup depicted in FIG. 4.
Figure 8:
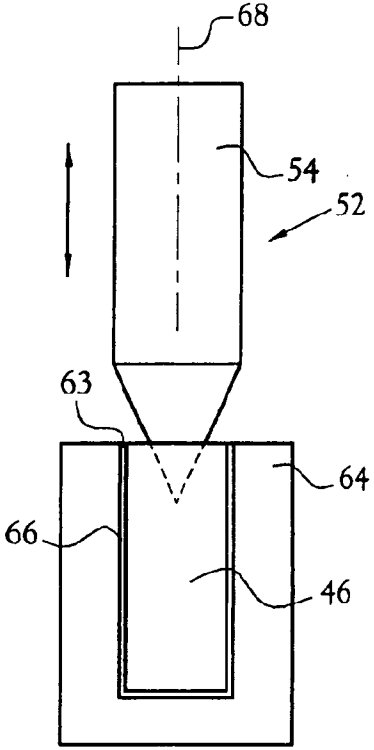
FIG. 8 depicts the step of hobbing a die punch pursuant to the setup depicted in FIG. 6.
Figure 11:
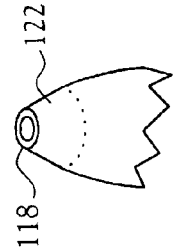
FIGS. 11–16 depict the leading end of each of a plurality of projectiles embodying various of the features of the present invention and produced pursuant to the method disclosed.
Figure 12:
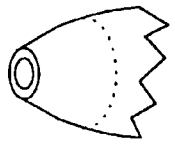
Figure 13:
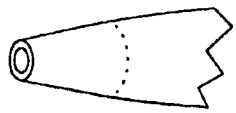
Figure 14:
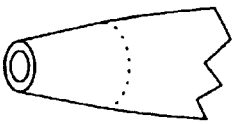
Figure 15:
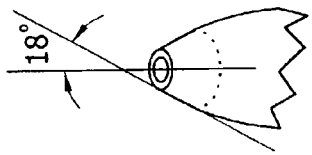
Figure 16:
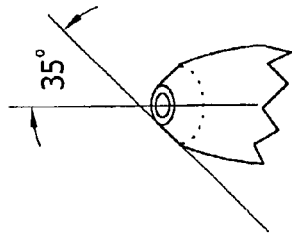

Referring to FIGS. 4–8, Further, in the production process the conical depression 44 in the die punch 46, following the reaming of the depression 44, the depression is "hobbed" with a hob 52 such as depicted in FIGS. 4, 7 and 8. The depicted hob comprises a mounting shank 54 and a conical head 56 which, after its initial formation is heat treated and polished to provide maximum hardness and smoothness of the conical head. The extension of the outer wall 58 of the hob defines an angle "B" of 45 degrees with respect to the longitudinal centerline 68 of the hob. The reaming operation is very precise and produces a very smooth finish on the inside wall 62 of the conical depression 44. However, the present inventors have found that a "mirror" finish is preferred on the inner wall of the depression, hence as seen in FIGS. 7 and 8, following reaming of the depression, the reamed die punch is placed in the cylindrical cavity 63 of a die 64 with the outer wall 66 of the die punch in intimate engagement with the inner wall of the die cavity such that the die punch can not expand radially to any material extent. Thereupon the hob is positioned within the conical depression and axial pressure is applied along the longitudinal centerline of the hob to force the hob into the conical depression and thereby smooth out any cut marks or the like which the reamer may have developed on the inner wall of the conical depression.

Figure 10:
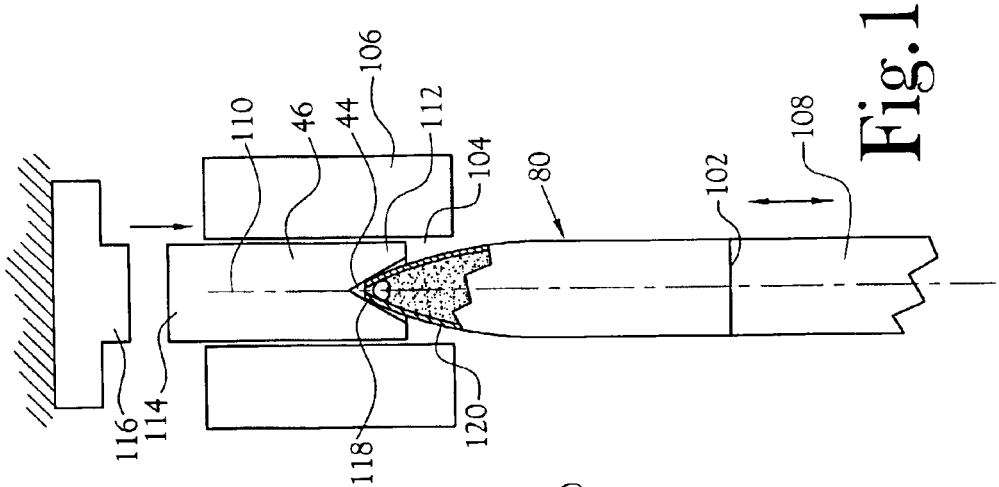
FIG. 10 depicts the formation of a tipped geometry on the ogive produced in the step depicted in FIG. 9.
Figure 9:
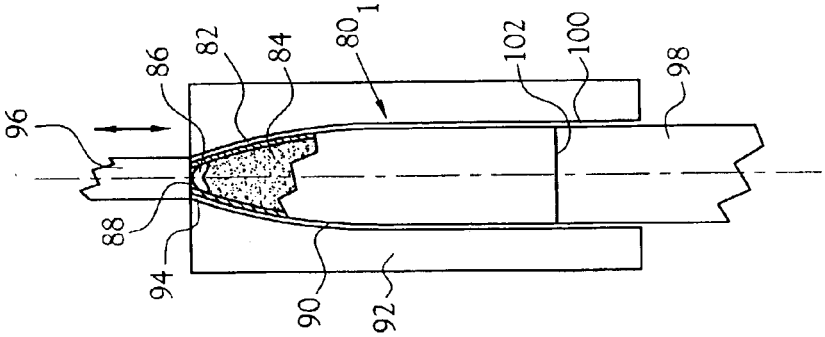
FIG. 9 depicts the formation of an ogive geometry on the leading end of a projectile in accordance with the present invention.

The die punch 46, having its hobbed conical depression 44 in one end 70 thereof, is employed in the formation of a tipped ogive of the present invention as depicted in FIGS. 9 and 10. In FIG. 9, there is depicted the operation of forming an ogive on a powder-based jacketed projectile 80. The depicted projectile comprises an outer metal jacket 82 which houses a core 84 formed from a quantity of cold compressed mixture of metal powders and a plug 86 disposed between the powder based core and the open end 88 of the jacket. To form the completed non-tipped ogive depicted in FIG. 9, the open end of the jacket is inserted into the cavity 90 of a die 92 having the desired ogive contour defined in a closed end 94 of the cavity. An extraction punch 96 is employed to close the ogive end of the die cavity and to extract the projectile from the die after the ogive is formed. A punch 98 inserted into that end 100 of the die cavity opposite the ogive end is employed to apply axial pressure against the closed end 102 of the jacketed projectile to urge the projectile into the ogive defining end of the die cavity to the extent desired for forming the ogive portion of the projectile. The projectile is thereafter ejected from the die.

Tipping of the ogive portion of the projectile of FIG. 9 is depicted in FIG. 10. As shown, in one embodiment of this procedure, the die punch 46 formed as depicted in FIGS. 5–8 is inserted into the cavity 104 of a die 106. Thereupon, the ogive end of the projectile is positioned in the conical depression of the die punch 46, following which axial pressure is applied by means of a further punch 108 to the closed end 102 of the projectile to urge the projectile toward the die punch 46. In one embodiment, the die punch 46 is unrestrained against longitudinal movement in the direction of the longitudinal centerline 110 of the die punch, within the cavity of the die 106 so that the projectile, acting against the end 112 of the die punch 46 can push the die punch upwardly as seen in FIG. 10 until the flat opposite end 114 of the die punch engages a rigidly mounted stop 116. At this position of the die punch, further pressure is applied to the closed end 102 of the projectile to cause the distal end 118 of the ogive portion 120 of the projectile to conform to the inner conical geometry of the depression 44 in the end of the die punch 46, thereby forming a conical tip 122 (see FIG. 11) on the extreme distal end 118 of the ogive portion of the projectile. Through selection of the relative position of the stop and the flat end of the die punch, and/or the limit of axial movement of the further punch, the present inventors select the depth to which the ogive portion of the projectile enters the conical depression in the die punch, hence the depth of the tip which is defined on the ogive portion of the projectile. This same selection procedure, along with the selection of the angles "A" and "B" of the reamer and hob, respectively, further provides for the extent to which the initially open end of the ogive portion of the projectile is further closed. This latter feature of the present invention is depicted in FIGS. 11–16 wherein there are depicted several possible combinations of tip depth and the angle of the tip wall relative to the longitudinal centerline of the projectile, as well as several degrees of closing of the extreme distal end of the ogive portion of the projectile.

The following Table presents representative combinations of tip depth and the size of the obtainable opening remaining in the end of the jacket of the projectile following the tipping operation:

TABLE I

| Caliber | Ogive | Depth (inch) | Opening Size (Dia.) (inch) |
|---|---|---|---|
| .223 | 5 | .003 | .007 |
| .223 | 7 | ~.006 | <.001 |
| .223 | 7 | .010 | .005 |
| .223 | 12 | .004 | .003 |
| .308 Win | 7 | .010 | .004 |
| .308 Win | 8 | .010 | .002 |

It is noted from Table I that the choice of depth of the tip, for a given ogive, may be employed to select the extent to which the open end of the ogive is closed. The size of such opening is generally chosen as a function of the desired terminal ballistics of the projectile as will be recognized by one skilled in the art.

For most caliber projectiles (50 caliber or smaller calibers), the angle "A" for the reamer may vary between about 2 degrees and about 45 degrees. In all instances, the angle "B" of the hob is to be the same as the angle of the reamer. Depths of the tip may vary between about 0.003 inch and about 0.4 inch. Tips having angular and depth parameters outside these ranges may be employed, but commonly projectiles having such outside parameters do not perform satisfactorily with respect to one or the other of the desired terminal ballistics or accuracy of delivery of the projectile to a target, especially at the longer ranges, such as 1000 yards or more.

As noted, projectiles having a tipped ogive portion as disclosed hereinabove, when fired from a gun, exhibited unexpectedly enhanced flight to a target, both in time of flight and accuracy of delivery. Moreover, the terminal ballistics of the projectile upon striking a target were substantially enhanced with respect to the frangibility of the projectile. Notably, the jacket portion of the projectile disintegrated into minute particulates whose energy was expended almost immediately, hence they did not present a possible danger to collateral targets as is known to exist for projectiles of the prior art. Moreover, the wound cavity developed by the imploding of the tipped portion of the projectile into the powdered core of the projectile was noted to be substantially enhanced as compared to wound cavities produced by like projectiles fired from like guns under like conditions.

Figure 17:
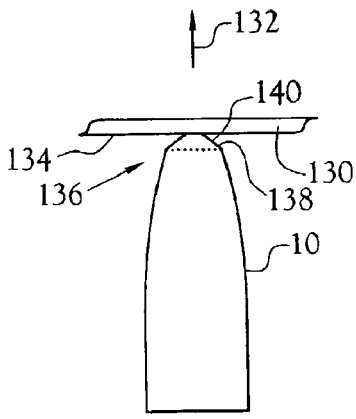
FIG. 17 depicts a projectile of the present invention immediately in time prior to the projectile striking a steel plate target from a direction perpendicular to the flat face of the target.
Figure 18:
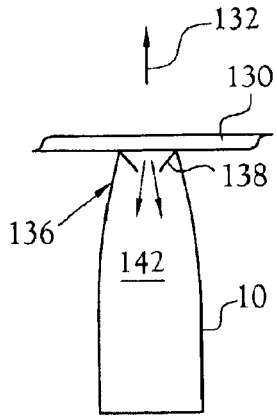
FIG. 18 depicts commencement of deformation of the leading end of and the commencement of the implosion reaction of the projectile of FIG. 17 briefly following contact of the leading end of the projectile with the target of FIG. 17.
Figure 19:
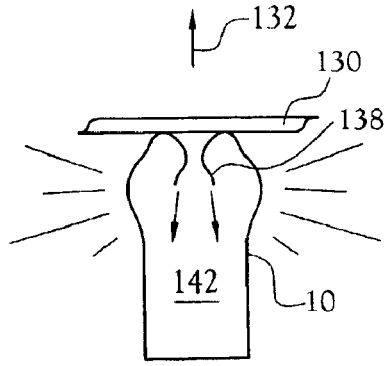
FIG. 19 depicts the implosion of the projectile of FIG. 17 as the projectile further deforms after striking the target.

Referring to FIGS. 17–19, tests involving firing of projectiles 10 of the present invention into a steel plate target 130 from a direction 132 perpendicular to the flat face 134 of the target indicate that the tipped ogive 136 on the leading end of the projectiles causes the tipped portion 138 of the extreme distal end 140 of the projectile to implode into the interior 142 of the projectile. This implosion reaction appears to proceed initially as depicted by the arrows of FIG. 18. Thereafter, it further appears that the projectile, including the powder-based core and the jacket, disintegrates and explodes into a very large number of small particulates which, because of their small size rapidly loose their kinetic energy and fall harmless away from the target. At distances of less than three feet from the face of the steel plate target, no harmful particulates of the projectile are evident.

Figure 20:
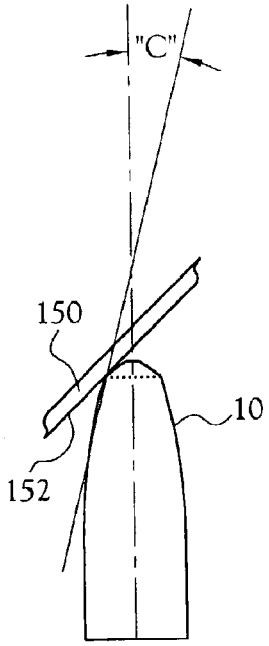
FIG. 20 depicts a projectile of the present invention immediately prior to the projectile striking a glass target at an angle of about 40 degrees between the trajectory of the projectile and the planar face of the glass target.
Figure 21:
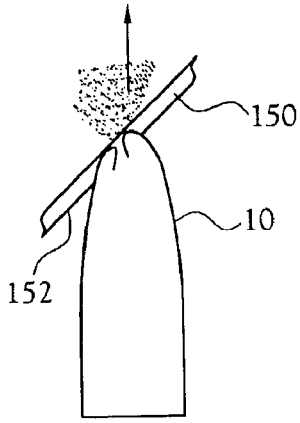
FIG. 21 depicts deformation of the projectile of FIG. 20 as the leading end of the projectile penetrates the thickness of the glass target.

As depicted in FIGS. 20 and 21, it has also been found that the tipped ogive projectiles of the present invention, when striking a glass target 150, such as the windshield of a motor vehicle, at an angle "C" of as much as about 40 degrees, penetrate and pass through the glass target in a straight line (see FIG. 21), as opposed to deflection of the projectile from its trajectory by reason of it passing through the glass target as is well known with respect to projectiles of the prior art.

Whereas specific examples and embodiments of the present invention have been described and/or depicted, it will be understood by one skilled in the art that various changes and/or modifications may be made in the presently disclosed invention without departing from the scope of the invention.

What is claimed:

1. A projectile having a longitudinal centerline and formed from one or more metal powders cold pressed into a core which is disposed within a cup-shaped jacket having a closed end and an open end, the open end being infolded to define an ogive portion of the projectile, comprising a further infolded conical distal tip defined on the extreme distal end of the ogive portion of the projectile, said ogive portion being defined by a first curved surface which is rotated about the longitudinal centerline of the projectile and said further infolded conical distal tip being defined by a second curved surface which is rotated about the longitudinal centerline of the projectile, said second curved surface having a greater angular value relative to the longitudinal centerline of the projectile than the angular value of said first curved surface of said ogive portion relative to the longitudinal centerline of the projectile, wherein said tip defines a continuous outer surface of said ogive portion of the projectile.

2. The improvement of claim 1 wherein said tip extends inwardly from the extreme distal end of the ogive portion of the projectile a distance less than the total length of the ogive portion of the projectile.

3. The improvement of claim 1 wherein said tip closes the open end of the projectile to a greater extent than does the ogive without the tip.

4. The improvement of claim 1 wherein said tip is of conical geometry and whose outer surface defines an angle of between about 2 and not greater than 45 degrees with respect to the longitudinal centerline of the projectile.

5. The improvement of claim 2 wherein said tip extends inwardly from the extreme distal end of the ogive of the projectile a distance of between about 0.003 and about 0.010 inch.

6. A method for the formation of a projectile having a longitudinal centerline comprising the steps of disposing a core in a cup-shaped jacket having a closed end and an open end and a continuous wall extending between said closed end and said open end thereof, at least partially closing said open end of said jacket to define an ogive having a distal end and an outer surface comprising a curved surface rotated about the longitudinal centerline of the projectile, further infolding said distal tip of said ogive to define a conical distal tip on the extreme distal end of said ogive portion of the projectile, said ogive portion being defined by a first curved surface which is rotated about the longitudinal centerline of the projectile, and said further infolded conical distal tip being defined by a second curved surface which is rotated about the longitudinal centerline of the projectile, said second curved surface having a greater angular value, relative to the longitudinal centerline of the projectile than the angular value of said first curved surface of said ogive portion relative to the longitudinal centerline of the projectile.

7. The method of claim 6 wherein said angular relationship of each of said conical tip and said ogive to said longitudinal centerline of the projectile is defined at the intersection of a tangent to the curved surface of a respective one of said tip and said ogive and said longitudinal centerline of the projectile.

8. The method of claim 7 wherein said acute angle of said tip relative to the longitudinal centerline of the projectile is of a value between about 2 and not greater than 45 degrees.

9. The method of claim 6 wherein the depth to which said tip extends in an inwardly direction of said projectile from said extreme distal end of said ogive is a distance of between about 0.003 and about 0.4 inch.

* * * * *

UNITED STATES PATENT AND TRADEMARK OFFICE

CERTIFICATE OF CORRECTION

PATENT NO. : 7,036,433 B2
APPLICATION NO. : 10/391881
DATED : May 2, 2006
INVENTOR(S) : Ferris Pindell and Harold F. Beal It is certified that error appears in the above-identified patent and that said Letters Patent is hereby corrected as shown below:

Inventorship should read:

Ferris Pindell
4615 So. State Road 1
Connersville, IN (US) 47331 and

Harold F. Beal
6277 Sierra Circle
Rockford, TN (US) 37853

Signed and Sealed this

Twenty-second Day of August, 2006

JON W. DUDAS
*Director of the United States Patent and Trademark Office*